United States Patent [19]

Boser et al.

[11] 4,269,128

[45] May 26, 1981

[54] LOW INERTIA TANDEMLY MOUNTED PRESSER MECHANISM

[75] Inventors: Ronald J. Boser, Dix Hills; Henry J. Watts, E. Northport, both of N.Y.

[73] Assignee: Union Special Corporation, Chicago, Ill.

[21] Appl. No.: 2,433

[22] Filed: Jan. 10, 1979

[51] Int. Cl.[3] ..... D05B 29/00; D05B 27/04

[52] U.S. Cl. ..... 112/235

[58] Field of Search ..... 112/235, 60, 61, 151, 112/237-239, 150, 320, 321, 134

[56] References Cited

U.S. PATENT DOCUMENTS

| | | | |
|---|---|---|---|
| 1,793,372 | 2/1931 | Moffatt | 112/235 |
| 1,988,399 | 1/1935 | Thompson | 112/235 |
| 1,988,401 | 1/1935 | Thompson | 112/151 |
| 2,288,404 | 6/1942 | Kahre | 112/235 |
| 2,481,175 | 9/1949 | Tamburro | 112/235 |
| 2,991,739 | 7/1961 | Joa | 112/235 |
| 3,295,484 | 1/1967 | Boser et al. | 112/235 X |
| 3,613,609 | 10/1971 | Hayes | 112/235 |
| 3,796,173 | 3/1974 | Godsen | 112/235 |
| 3,863,580 | 2/1975 | Marforio | 112/235 X |

*Primary Examiner*—Werner H. Schroeder

*Attorney, Agent, or Firm*—John W. Harbst; John A. Schaerli

[57] ABSTRACT

This invention relates to a presser mechanism for sewing machines which includes a pair of independently tandemly mounted presser foot soles arranged to cooperate with the feed mechanism of the machine in advancing the workpiece along a directed path of travel. Different selectively variable pressures may be applied to the presser foot soles such that both a firm heavy pressure and a resilient lesser pressure is applied to the workpiece as it travels along its directed path of travel.

8 Claims, 4 Drawing Figures

LOW INERTIA TANDEMLY MOUNTED PRESSER MECHANISM

FIELD OF THE INVENTION

This invention relates to sewing machines and is principally concerned with a presser mechanism which is adapted to cooperate with the feed mechanism of the machine in advancing a workpiece along a directed path of travel.

BACKGROUND OF THE INVENTION

It is generally well known in the art that it has proven difficult to sew a wrinkle-free seam when attaching rubber or elastic tape to the edge of a non-stretchable workpiece such as cotton or the like. The sewing operator had been faced with the perplexing problem of how to advance equal lengths of the workpiece and elastic between the presser foot and the feed mechanism without stretching the elastic. That is, the pressure on the foot which is necessary to advance the workpiece through the machine may cause the elastic to stretch thus resulting in certain amounts of wrinkling.

It may be suggested that one solution to the stretching of the elastic problem may be to reduce the pressure on the foot to a point whereat the stretching of the elastic is eliminated. However, the provision of such a slight pressure may prove to be insufficient for the foot to interreact with the feed mechanism in advancing the workpiece through the machine.

Further, when the presser foot passes over a seam or other thickened portion of the workpiece, the entirety of the foot may be lifted or tilted. As one skilled in the art may appreciate, when the presser foot bottom is removed or raised from contact with the workpiece it enhances the possibility of skipped stitches. These conditions are, of course, objectionable.

SUMMARY OF THE INVENTION

In an effort to eliminate the described problem of feeding the elastic beneath the pressure of the foot, there has been devised a presser foot assembly which is constructed so that a minimum of pressure is initially exerted against the elastic and workpiece; whereafter, once the elastic strip and workpiece are secured together an imperative heavier pressure is exerted so as to efficiently and effectively advance the sewn article through the machine.

The presser foot assembly of this invention includes a first presser foot section which is of very light construction and is substantially devoid of any material stretching action and a second presser foot section which is independently arranged directly behind and in line with the first presser foot section and is flexibly mounted relative thereto. The tandemly mounted presser foot sections are attached to a support body which may be carried at one end of a resiliently biased presser arm. The second presser foot section is adapted to receive the direct or full pressure of the presser arm while the other section is urged toward the workpiece under a lesser pressure. Thus, the workpiece as it travels along its directed path of travel is subjected to a plurality of different pressures.

Applicants, having recognized that it was necessary to independently mount the presser foot sections so that a plurality of pressures could be applied to the workpiece, recognized that, when properly mounted, the first presser foot section could impart a work feeding motion to the workpiece. In this regard, applicants proceeded to derive suitable means for achieving this purpose. Accordingly the present invention provides means for controlling the magnitude of the pressures applied against the presser foot sections.

Accordingly, it is a principal object of this invention to provide a presser mechanism having means which enable sewing of a wrinkle-free seam comprised of elastic and some non-stretchable workpiece.

Another object of this invention is to provide a presser mechanism having means adapted to exert a plurality of pressures upon the workpiece as it is advanced along its directed path of travel.

A further object of this invention is to provide a multi-pressure presser mechanism which makes it possible to substantially reduce any holding back of an elongated strip while at the same time effectively advancing the workpiece through the machine.

With the above and other objects in view that will hereinafter appear, the nature of the invention will be more clearly understood by reference to the following detailed description, the appended claimed subject matter and the several views illustrated in the accompanying drawings in which:

DETAILED DESCRIPTION OF THE PREFERRED EMBODIMENT

Figures 1, 2:
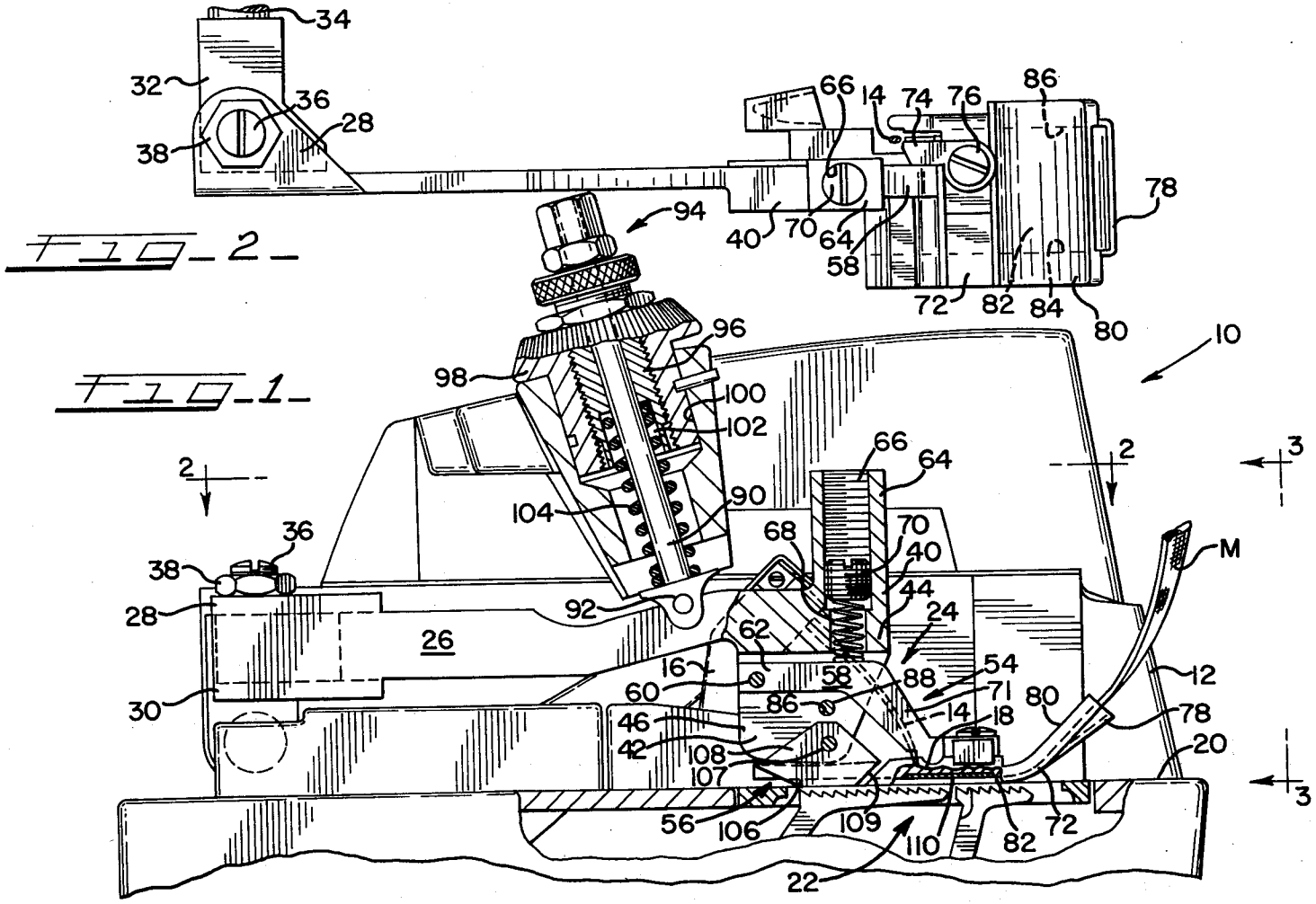
FIG. 1 is a side elevational view, partly in section, of the presser mechanism and associated parts of the sewing machine.
FIG. 2 is a view of the presser foot assembly taken on line 2—2 of FIG. 1.
Figure 4:
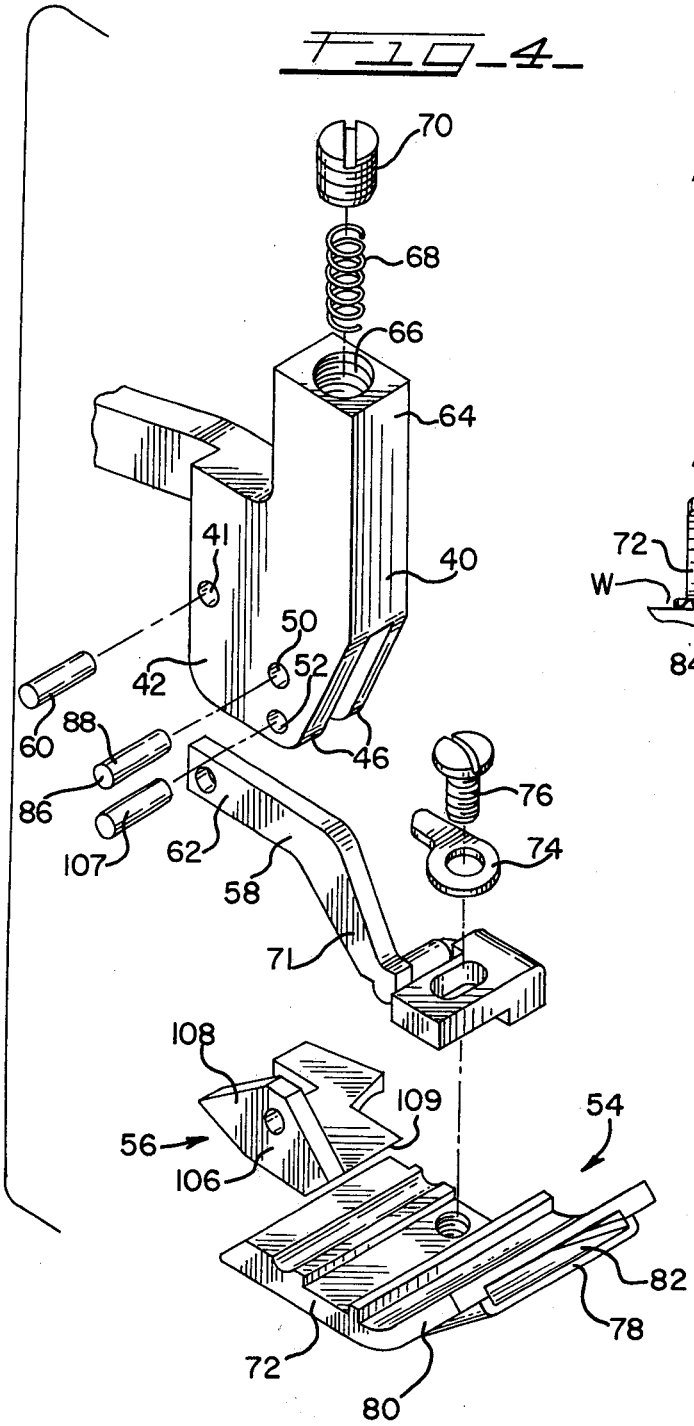
FIG. 4 is a disassembled perspective view of the presser foot assembly.
Figure 3:
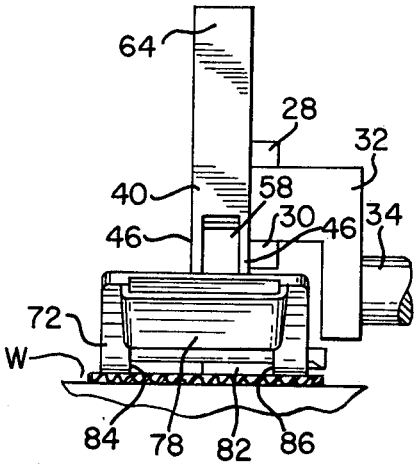
FIG. 3 is a view of the presser foot assembly taken along line 3—3 of FIG. 1.

Referring now to the drawings in which like reference numerals indicate like parts through the several views, it may be seen that there is illustrated in FIG. 1 a conventional sewing machine which is generally identified by reference numeral 10. The sewing machine may be of the overedge sewing type sold by Union Special Corporation under the designation 39500RF. Thus it is not necessary to describe within the framework of the present application all of the complex multiple mechanisms which are incorporated into such a machine. It should be understood, however, that the invention is adapted for performing on other types of machines as well. Suffice it to say that the machine 10 includes a frame 12 and a needle means 14 fastened to a needle carrier 16 which is supported for reciprocation by instrumentalities which are located in the frame 12 but not shown. The sewing needle 14 cooperates with other sewing instrumentalities (not shown) in the formation of stitches in a workpiece W (FIG. 3) which is supported at the stitching zone 18 by the usual work support means 20. The machine 10 is further provided with a differential feed mechanism generally indicated at 22 which is well known to one skilled in the art of sewing machine and thus no further time will be devoted thereto.

Referring to FIG. 1, there is shown a presser mechanism 24 which is the subject of the present patent application. The presser mechanism 24 may be attached or carried at one end of a presser arm 26 whose longitudinal axis extends parallel to the work support means 20. The presser arm 26 is fashioned at its other extremity with a pair of oppositely disposed ears 28 and 30 between which is secured a lug extremity 32 of a rock shaft 34. The rock shaft 34 may be operatively connected to a knee or foot lifter (not shown). The lifter may be shifted so as to rotate the rock shaft 34 which, through the lug extremity 32, will rotate the presser arm 26 counterclockwise as viewed in FIG. 1 whereby lifting the presser mechanism 24 from contact with the work support means 20. Thus, the rock shaft 34 forms a horizontal pivotal axis for the presser foot assembly 24. Fastening means 36 is secured by nut 38 to ear 28 and provides for horizontal rotation of the presser arm 26 thus forming a vertical axis pivot for the presser foot assembly or mechanism 24.

The presser mechanism 24 includes a mounting bracket 40 which is attached to one end of the presser arm 26 and includes a rearwardly and downwardly extending portion 42 as seen from the position of the operator. It will be seen from the illustration that the portion 42 of bracket 40 is bifurcated and provides for a solid top portion 44 and two depending spaced walls 46. The spaced walls 46 are provided with a plurality of apertures 41, 50 and 52. Accomodated in the void between the two walls 46 are two presser foot sections 54 and 56. It is worthy to note that the first presser foot section 54 is independently mounted with respect to the presser foot section 56. That is, the presser foot section 54 may be raised or lowered while having no effect on the other presser foot section and the converse is also true. So as to independently mount the first presser foot section 54 to the mounting bracket 40 there is provided a cantilever or member means 58 which is adapted for pivotal movement on a pin means 60. The pin means 60 may be received in the aperture designated 41.

As seen in FIG. 1, one arm 62 of cantilever 58 extends generally horizontal under the solid top portion 44 of the bracket or mounting means 40. Extending from the solid top portion 44 of bracket 40 is a struck up member means 64. The struck up member 64 may be formed with an opening or a bore 66 which, in turn, provides a housing for a resilient member 68 which, in the preferred embodiment, is a compression coil spring. The lower end of the spring 68 bears down against the arm 62 of lever 58 while the upper end of the spring impinges against a stop means 70. In order to facilitate adjustment of the magnitude of pressure exerted against the first presser foot section, the stop means 70 may be formed as a screw which may be threadably engaged with the bore 66 and be vertically adjustable therein so that, depending on the vertical position of the screw, the spring is able to apply more or less pressure against the lever 58. The first presser foot section 54 is, therefore, not only independently movable relative the second presser foot section 56, but the pressure of the first presser foot section is also independently or individually adjustable. The spring 68 and associated mechanism serve to bias the other arm 71 of the lever 58 in a downward direction. The arm 71 slopes downwardly from the arm 62 of lever 58 and is pivotally connected at its extreme lower end to a presser foot sole 72 by any suitable means which are known in the art such as flat spring and screw means 74 and 76, respectively.

It should be noted that the major portion of the presser foot sole 72 extends forward of the stitching zone as seen by the operator. In addition, in view of the depicted way of mounting the presser foot section the pressure of the presser arm is prevented from acting directly on the sole plate 72 and only the auxiliary spring means 68 acts to urge the presser foot sole 72 downwardly during the normal operation of the sewing machine. Since the moving parts of the first presser foot section 54 have a very low mass and are not subject to the pressures exerted by the presser arm, a minimum of inertia forces will be developed and the presser foot sole 72 will follow the movements of the feed mechanism 22 with a minimum of overthrow.

As can be seen in FIGS. 1 through 4, the presser foot sole 72 may be provided with a strip guide means 78 which can be mounted on the toe portion 80 of the sole 72. Extending up the toe portion and along the undersurface of the sole 72 is a channel 82. The channel may be of a depth slightly greater than the thickness of the strip like material M (FIG. 1) which is to be secured to the workpiece. This channel in the presser foot section provides guide walls 84 and 86 which may aid in positioning the elongated strip for presentation to the stitch forming instrumentality.

When the presser mechanism 24 is lifted clear of the work support 20, the downward movement of the first presser foot section 54 under the influence of spring 68 will be limited by engagement of arm 62 with a pin 86 received in apertures 50, which pin thus constitutes a stop means 88. On the otherhand, and as may be best seen in FIG. 1, the location of the stop means 88 is such that it allows a limited degree of downward movement of the lever when the presser mechanism is in its operative position so as to not interfere with the first presser foot section cooperating with the feed mechanism in advancing the workpiece along a directed path of travel.

Also visible in FIG. 1, is a presser spring plunger 90 having provided at one end a bifurcated head 92 which is adapted to straddle the presser arm 26 and at the other end may be provided with a lock and cap assembly 94. Telescopically arranged intermediate the ends of the plunger 90 is a pressure adjusting screw 96 which, in turn, may be threadably received by a presser foot release bushing 98. The presser foot release bushing 98 is received within a bore 100 formed in the frame 12 of the machine. The adjusting screw 96 may be provided with a recessed bore 102 into which is inserted one end of a main presser spring 104. The other end of the presser spring 104 impinges against the bifurcated head of the plunger 90 and is adapted to apply a downwardly directed force against the presser arm 26 when the presser foot release bushing is in its operative position.

The second presser foot section 56 includes a presser foot sole 106 having an upstruck portion means 108 adapted for pivotal connection, by means of a transverse pin means 107 which is received in the aperture 52 in the mounting bracket 40. As shown in FIG. 1, the presser foot sole 106 has its front end chamfered as at 109 to facilitate mounting of the foot as closely proximate to the first presser foot section as possible. In addition, it is worthy to note that the presser foot sole 106 is colinearly aligned with the presser foot section 54. However, in the preferred embodiment, the entire second presser foot section 56 is disposed rearward of the stitching zone as viewed by the operator. Not like with the first presser foot section 56, the heavy or full pressure of the spring 104 is imparted to the second presser foot section 56 whereby allowing it to cooperate with the feed advancing means in its normal manner. As is apparent, since the second presser foot section engages the elastic only after it has been secured to the nonstretchable workpiece the operator need not worry about any stretching of the elastic strip and, therefore, the operator can impart the imperative heavy pressure required for advancing the workpiece through the machine.

With further reference to FIG. 1, it will be seen that a "Teflon" type strip 110 may be fixed in the channel 82. As is apparent, the "Teflon" strip should aid in the objective of applying little or no tension to the elastic strip by helping to reduce the friction as it is fed to the sewing instrumentalities. The "Teflon" strip may be cemented or otherwise affixed in the channel 82.

OPERATION OF THE DEVICE

In operation, the pressure spring 68 exerts a resilient yielding force on the lever 58 thus urging the first pressure foot section 54 toward the work supporting member of the machine. At the same time, the pressure spring 104 is exerting the heavier pressure against the arm 26 thus urging the second presser foot section toward the work support means of the machine. However, in view of their independence, the main pressure spring 104 is prevented or precluded from acting directly on the first pressure foot section. As a consequence, during the normal operation of the sewing machine the workpiece W, as it passes along its direct path of travel, is subjected to a plurality of varying pressures. That is, with the preferred embodiment, the elastic strip and the workpiece are first advanced under the influence of the light pressure exerted on the workpiece by the first presser foot section and after the pieces are secured they are then subject to the heavier pressure of the second presser foot section. In this manner the operator may be able to utilize one foot for feeding equal lengths of work to the stitching zone under both a light resilient pressure thus preventing the elastic from stretching and then subjecting the workpiece to the imperative heavy pressure so as to assure effective and efficient feeding of the workpiece through the machine.

When a cross seam or the like is encountered the individuality of the present invention may prove beneficial in aiding with the formation of stitches. That is, the separate mounting of the presser foot sections will allow the first presser foot section to raise independently of the second presser foot section. Accordingly, the first presser foot section is effective to maintain the raised or cross seam portion of the workpiece against the work support while the second presser foot section is effective to maintain the lower or single ply workpiece against the work support whereby insuring that the material may be stripped from the needle thus aiding the stitching mechanism in the formation of stitches.

In addition to all of the above mentioned advantages, the presser mechanism of this invention may further allow the first presser foot section to operate in a work feeding direction during the sewing cycle. The work feeding movement exerted by the first presser foot section 54 on the workpiece is believed to result from the fact that during the rise of the feed mechanism at the onset of the feeding stroke, the arm 58 being hinged in such a relation to the mounting means 40 will move the sole 72 on an arcuate path about the hinged connection 60 so that it moves both upwardly and a small increment forwardly in the direction of the operator. In view of the fact that the workpiece is secured by the stitching mechanism rearward of the presser foot section the material cannot be pushed forwardly toward the operator. However, this increment of the presser foot movement toward the operator is reversed during the terminal portion of the feed stroke thus allowing the presser foot sole 72 to act in concomitantly advancing the workpiece in the direction of feed.

Thus it is apparent that there has been provided, in accordance with the invention, a presser mechanism for sewing machines that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the claims.

We claim:

1. For use with a sewing machine adapted to sew an elongated strip to a workpiece, said machine including stitch forming instrumentality means, feed mechanism means, a work support means, a pressure biased presser arm and a presser foot assembly comprising:

bifurcated member means attached to one end of said presser arm;

first presser foot sole means;

oscillatable link means for connecting said bifurcated member and said presser foot sole means, said link means being operatively disposed between said first presser foot sole means and said presser arm so as to preclude the pressure of said presser arm from being applied to said first presser foot sole means;

means for applying a variable force against the link means whereby urging the first presser foot sole means toward said work support means;

second presser foot sole means arranged independently of and in tandem with said first presser foot sole means, said second presser foot sole means being carried by said bifurcated member means such that it is flexibly mounted relative to said first presser foot sole means; and said pressure biased presser arm being effective to separately apply a force having a magnitude greater than the force magnitude applied against said first presser foot sole means for urging the second presser foot sole means toward said work support means.

2. The presser foot assembly according to claim 1 wherein said first presser foot sole means is provided with a groove means adapted to guide said elongated strip to said stitch forming instrumentality means.

3. The presser foot assembly according to claim 2 wherein a portion of said groove means is covered with a "Teflon" coating.

4. The presser foot assembly according to claim 1 wherein said bifurcated member means is provided with stop means for limiting the downward movement of the first presser foot sole means when the presser foot assembly is lifted.

5. The presser foot assembly according to claim 1 wherein said first presser foot sole means is adapted to guide the elongated strip to said stitch forming instrumentality and to concomitantly advance the workpiece with said feed mechanism means.

6. A presser foot assembly according to claim 1 wherein said second presser foot sole means is adapted to engage the sewn strip and workpiece and cooperates with said feed mechanism means in moving the workpiece along a directed path of travel.

7. A presser foot assembly for a sewing machine having a work support means, a spring biased presser arm and feed mechanism means for advancing a workpiece along a directed path of travel, said presser foot comprising:

support means arranged at one end of said presser arm, said support means being provided with a bore into which an independent biasing means is to be fitted;

first and second presser foot section means arranged in tandem and adapted to cooperate with said feed mechanism means in advancing the workpiece;

one of said presser foot section means being mounted to the support means and adapted to receive the full pressure of said presser arm;

means for coupling the other presser foot section means to said support means such that it is flexibly mounted relative to said first mentioned presser foot section means whereby minimizing the effect of the spring biased arm on said other presser foot section means; and independent biasing means comprising a compression spring adapted to operatively associate with said means for coupling and arranged to separately and resiliently urge said other presser foot section means toward said work support means under substantially less pressure than that applied to said presser arm whereby substantially reducing any holding back of the workpiece by said other presser foot section means during the work feeding movement.

8. The presser foot assembly of claim 7 further including means for selectively adjusting the magnitude of the force imparted to said other presser foot section means.

* * * * *